United States Patent [19]

Rudt

[11] 4,426,795

[45] Jan. 24, 1984

[54] DRYER FELT FABRIC AND DRYER BELT

[75] Inventor: Robert J. Rudt, East Greenbush, N.Y.

[73] Assignee: Albany International Corp., Albany, N.Y.

[21] Appl. No.: 288,973

[22] Filed: Jul. 31, 1981

[51] Int. Cl.[3] ..... F26B 13/08

[52] U.S. Cl. ..... 34/116; 34/123; 139/383 A; 139/425 A

[58] Field of Search ..... 34/116, 123, 243 R; 139/383 A, 425 A; 162/358, 359, 428

[56] References Cited

U.S. PATENT DOCUMENTS

| | | | |
|---|---|---|---|
| 3,573,164 | 3/1971 | Friedberg et al. | 139/383 A |
| 3,867,766 | 2/1975 | Wagner | 34/71 |
| 4,192,080 | 3/1980 | Irpola | 34/41 |

*Primary Examiner*—Larry I. Schwartz

*Attorney, Agent, or Firm*—Kane, Dalsimer, Kane, Sullivan & Kurucz

[57] ABSTRACT

The disclosure is of a dryer felt and dryer felt fabric for use in a paper making machine. The fabric is characterized in part by an increased paper contacting surface in the center of the belt. The fabric has an enhanced operating life as a dryer felt since the machine direction yarns are protected at the edges from direct contact with the hot dryer cans on the sheet side and in its entirety from typically abrasive carrying rolls on the back side. The improved drying efficiency in the center of the belt compensates for the prior art decreased drying efficiency at the center of the paper web being dried. This gives a uniform moisture content across the width of the drying paper web.

8 Claims, 4 Drawing Figures

DRYER FELT FABRIC AND DRYER BELT

BACKGROUND OF THE INVENTION

1. Field of the Invention

The invention relates to paper machine clothing and more particularly relates to fabrics useful as dryer felts, belts made therefrom and their use on papermaking machines.

2. Brief Description of the Prior Art

The art is replete with descriptions of dryer felts and dryer felt fabrics. In spite of the wide variety of materials available, the ideal dryer farbic is yet to be found for use in fabricating papermachine dryer belts.

One of the problems associated with the prior art dryer felt fabrics is an uneven moisture profile in the web of paper carried by the dryer felt through the drying section of a papermaker's machine. The problem is fully described in U.S. Pat. No. 3,867,766. In brief, instead of having the same moisture content across the width of the paper web, a higher moisture content develops in the center of the paper web being dried and lower moisture contents develop along the lateral edges of the moving paper web. This is undesirable in that it necessitates overdrying of the web which affects the quality of the final paper product and consumes large amounts of additional energy. Furthermore, the cost of paper produced in this manner is higher because the lower final moisture in the product means a correspondingly higher proportion of fiber. Finally, it is known that paper webs with higher moisture contents have various properties making them more desirable in secondary operations. The solution to this problem offered by the patentee in the U.S. Pat. No. 3,867,766 is to provide a dryer belt having greater permeability in the center than along the lateral edges; i.e.; along the felt edges in the machine direction. The difference in permeability is achieved by varying the diameter of the machine direction yarns of the dryer felt fabric in the different zones; i.e.; at the center and along the lateral edges. It will be appreciated that such an approach complicates the weaving of the fabric and increases costs.

A different approach to the above-described problem was taken by the patentee of U.S. Pat. No. 3,151,953. Variable pressures are exerted on the dryer felt across its width, i.e; higher pressures at the center so that the paper web is pressed to a higher degree in the center against the heated drying surface. An acceleration of drying rate at the center of the paper web is achieved in comparison to along the lateral edges of the moving paper web. It will be appreciated that adjustment of the variable pressures across the width of the machine is difficult and not subject to objective controls. Uniformity in the final paper product is difficult to achieve.

Other approaches to obtaining uniform moisture profile in the drying paper web have included varying the reeding of the dryer felt fabric. Variable reeding of the fabric is undesirable for many reasons, including the fact that the fabric must then be woven to width (putting severe limitations on the use of stock rolls). Also, the fabric tension is uneven across this type of fabric, leading to fabric instability.

Treatment of fabric lateral edges parallel to the machine direction to reduce permeability is not desirable. Such treatments generally compromise guidability of the dryer felt.

By the present invention, a uniform moisture profile in paper webs passing through the dryer section of a papermakers' machine is achieved by the employment of a dryer felt having a surface of controlled paper contacting area. The dryer felts of the invention are stable, exhibit excellent guidability and are readily operable with a minimum of adjustments and operating difficulties. The dryer felt fabrics from which the felts are made need not be custom woven to width but may be cut from stock weavings. Drying rates are controlled by controlling the surface area contact between the paper web and the dryer felt rather than by controlling air flows through the dryer felt, the latter control being imprecise and difficult to maintain.

In recent years, dryer fabrics have been developed which are constructed partially or entirely from monofilaments. However, such fabrics have not been entirely satisfactory when employed in fashioning dryer felts. The monofilaments are subject to abrasion and hydrolysis. In some prior art constructions the load bearing machine direction monofilament yarns may be rapidly degraded under some conditions of use so that the life of the dryer felt is shortened.

In the preferred embodiment structured fabrics of the present invention, employed as dryer felts, the cross-machine direction yarns are predominant on both fabric surfaces. machine direction yarns are thus protected from direct contact with degradative elements. The overall operating life of the dryer felt is significantly increased over felts where the machine direction yarns are in contact with the hot cans on the sheet side or the felt carrying rolls on the back side.

Other U.S. patents bearing descriptions representative of the state of the art in regard to dryer fabrics are U.S. Pat. Nos. 3,573,164 and 3,905,863.

SUMMARY OF THE INVENTION

The invention comprises a dryer felt fabric for use in a dryer felt, which comprises; a flat woven dryer felt fabric having a substantially higher paper sheet contacting surface area per square meter at its center than along its lateral margins running in the machine direction.

The invention also comprises an endless dryer felt for use in the dryer section of a papermakers' machine, which comprises;

a flat woven dryer felt fabric having a first end and a second end, said ends being seamed together to form an endless dryer felt belt;

said belt having a central portion from end to end and defined by a first lateral edge portion and a second lateral edge portion, said central portion intermediate the first and second lateral edge portions.

The central portion having a paper sheet contacting surface area per square meter substantially greater than the paper sheet contacting surface area per square meter of the lateral edge portions.

In a preferred embodiment dryer felt belt of the invention, the fabric employed as the dryer fabric comprises;

a first sinuous layer of cross-machine direction yarns, providing a fabric first periphery of peaks and valleys wherein a plurality of peaks are in a first outside plane and the valley floors are in a first inside plane, said peaks being of a character which provides about 20 to 50 percent of the surface area of the first periphery and 100 percent of the area which will come in contact with the paper sheet to be supported by the felt on a paper machine; p a second sinuous layer of cross-machine direction yarns, providing a fabric second periphery of peaks and valleys wherein a plurality of peaks are in a second outside plane and the valley floors are in a second inside plane;

a plurality of monofilament machine direction yarns positioned between the first and second outside planes and interweaving the cross-machine direction yarns of the first and second layers at points between the outside and inside planes of at least one of said first and second layers and at points within the periphery of the other of said first and second layers;

said belt having a central portion defined and bounded by lateral margin portions along the machine direction of the fabric;

said central portion having a substantially greater sheet contacting surface area per square meter than found in the lateral margin portions.

DETAILED DESCRIPTION OF THE PREFERRED EMBODIMENTS OF THE INVENTION

Figure 1:
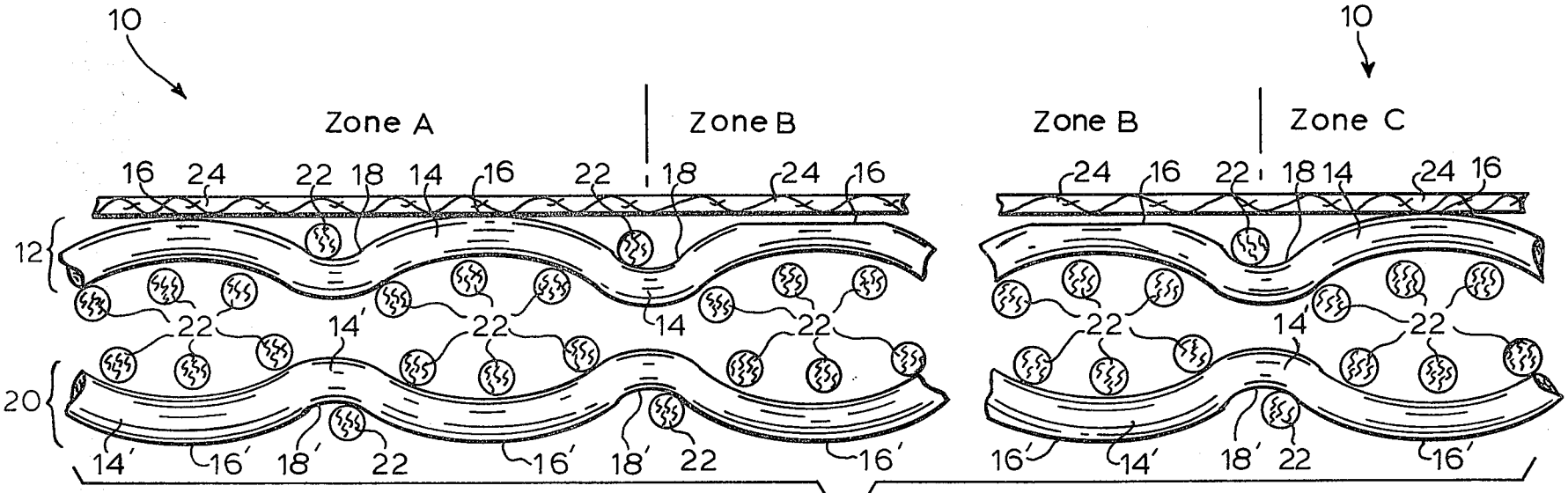
FIG. 1 is a cross-sectional, side elevation of a portion of a preferred embodiment fabric of the invention, as seen along lines 1—1 of FIG. 3.
Figure 3:
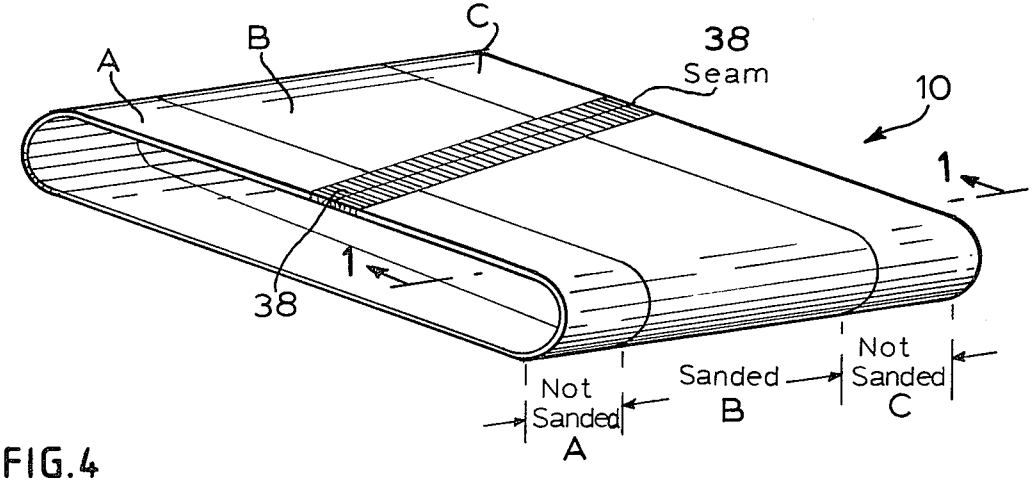
FIG. 3 is a view-in-perspective of an embodiment dryer belt of the invention, made of the fabric of FIG. 1.

FIG. 1 is an enlarged, cross-sectional, side elevation of a portion of an embodiment fabric 10 of the invention as seen along lines 1—1 of FIG. 3. The fabric 10 comprises a first sinuous layer 12 of monofilament cross-machine direction yarns 14. The layer 12 forms a periphery of fabric 10 which in side profile shows peaks 16 and valley floors 18. A plurality of at least two peaks 16 in layer 12 are in a single plane forming an outer periphery of fabric 10. Preferably at least about 50 percent, most preferably all or substantially all of the peaks 16 are in the aforesaid outer periphery. Valley floors 18 are in a separate plane below the plane formed by the peaks 16.

A second sinuous layer 20 of monofilament cross-machine direction yarns 14' forms another periphery of the fabric 10 which also appears, in side profile, as peaks 16' and valley floors 18'. A plurality of at least two of the peaks 16' are in a single plane forming the outer periphery (preferably at least about 50 percent, most preferably all of the peaks 16' are in the periphery). Valley floors 18' are in a separate, single plane inside of the plane formed by peaks 16'.

A plurality of machine direction yarns 22 are positioned between the outer fabric periphery formed by the outside planes, formed by the peaks 16 and the peaks 16' and interweave with the cross-machine direction yarns 14, 14' at points between the respective planes of peaks 16, valley floors 18 and peaks 16', valley floors 18'. Thus, as shown in FIG. 1, zone A, the knuckles of load bearing machine direction yarns 22 are below the peaks 16, 16' at the point where they interweave with the cross-machine direction yarns 14, 14' and do not come into direct contact with the sheet 24 of paper carried on fabric 10, when fabric 10 is employed as a dryer fabric on a papermaking machine. The sheet 24 is supported on the peaks 16 of the cross-machine direction yarn 14 and in the central portion "B" of the embodiment fabric in FIG. 1 by the machine direction yarns 22 as well. On the side of fabric 10 facing away from the carried sheet, the machine direction yarns 22 are also protected by the outwardly projecting peaks 16' from contact with elements of the paper making machine which might hasten abrasion,hydrolysis, or other degradation of the important load bearing machine direction yarns. However, it will be appreciated that the greatest degradation of yarns in a dryer fabric occurs in those yarns on the sheet side at the edges of the fabric in contact with hot dryer cans, and on the surface of the fabric facing away from the carried sheet 24 for the full width where the fabric comes in contact with typically abrasive felt rolls. Thus, it is most desirable that yarns 22 be protected by peaks 16 and 16'. Within the scope of the invention are fabrics where the yarns 22 are on the outer periphery of layer 20 where they pass through layer 20.

In the embodiment fabric 10 the machine direction yarns 22 within layer 12 are paired with the yarns 22 within layer 20 and the yarns within the pairs are slightly offset from each other in regard to vertical alignment, as they knuckle over the cross-machine direction yarns 14, 14'. There are, in the weaving pattern, 4 sets of machine direction yarn 22 pairs. One pair interweaves with every fourth of cross-machine direction yarns 14, 14' and then the pattern repeats. Preferably, the machine direction yarns pass over at least one cross-machine direction yarn, under at least one following cross-machine direction yarn and over at least one further following cross-machine direction yarn of the upper cross-machine direction layer before running down to interconnect to lower cross-machine direction layer with the upper cross-machine direction layer, the machine yarns and cross-machine direction yarns being thus interconnected in a repeat pattern. Of course, the weave will be such that the relationship of the plane of the upper surface portions of the machine direction yarns where they cross-over the cross-machine direction yarns and the plane of the upper surface portions of cross-machine direction yarns will be such that the plane of the upper surface portions of the cross-machine direction yarns of the upper layer is relatively elevated in a direction away from the plane of the upper surface portions of the machine direction yarns, whereby the differences in elevation between the exposed upper surface portions of the machine direction yarns are protected from contact with degrading elements which contact the surface of the cross-machine direction yarns in the upper layer. Since the weave is symmetrical, the same is true for the lower layer.

The yarns 14, 14' and 22 may be monofilaments and of any synthetic polymeric resin. The yarns 14, 14' and 22 may also be multifilament yarns. Representative of such multi- and monofilaments are yarns of polyester, polyamide, polyolefin, polyaramid, polyimide and the like. Generally such yarns having diameters of from 10 to 40 mils are advantageously employed in the fabrics of the invention.

Following the weaving of the fabrics of the invention, they are heat set to stabilize the fabric and to draw the yarns into their desired relative positions. The machine direction yarns 22 are drawn inwardly of the outer surfaces of the fabric 10 and this pressure "crimps" the yarns 14, 14' so that the peaks 16, 16' are displaced to the outside plane of the fabric as previously described. The degree of heat-setting required to achieve the desired structure of the fabric 10 will of course vary depending on the nature of the yarns 14, 14' and 22. However, optimum times, temperatures and tensions placed on the fabric during heat-setting can be determined by those skilled in the art, employing trial and error technique for the different yarn materials. In general, heat-setting may be carried out at temperatures of from about 150° F. to 375° F. for from 15 to 60 minutes.

Figure 2:
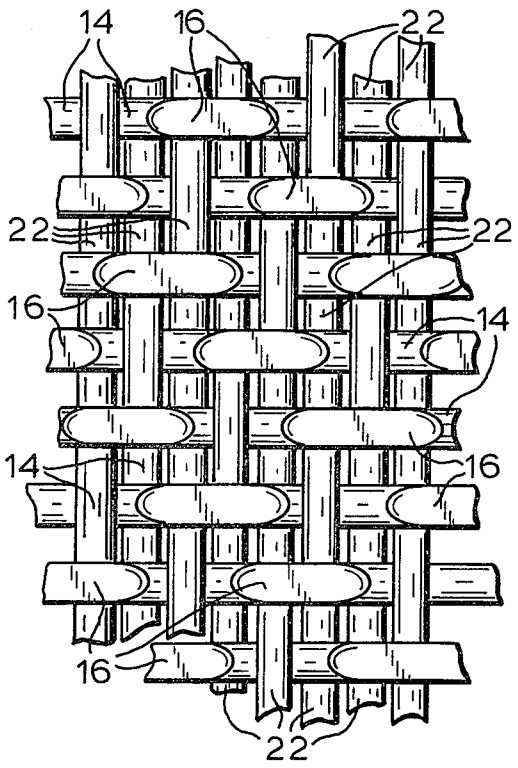
FIG. 2 is a top view of a center portion of the fabric of FIG. 1.

As shown in FIG. 1 and FIG. 2, a top view of the center portion "B" of the embodiment fabric of FIG. 1, the outermost portion or "knuckle" of peaks 16 have been partially abraded away in the central portion "B" (see also FIG. 3) to increase the surface area of the fabric 10 which functions as the support area for the central portion of the paper sheet 24. The technique of abrading or sanding away portions of knuckles on fabrics is well known; see for example U.S. Pat. Nos. 3,573,164 and 3,905,863.

Advantageously, sufficient of the peaks 16 are abraded away in the central portion "B" of the fabric 10 to provide peaks 16 which in combination with the contact afforded by the top layer of machine direction yarns 22, results in a surface area comprising from about 20 to about 50 percent of the total surface area of the portion "B" of the dryer fabric, in the outer periphery of layer 12. Most advantageously, the abraded peaks 16 and 22 comprise from 10 to 20 percent of the total surface area in portion "B". When the peaks 16 and 22 provide the specified surface area of the dryer fabric, the dryer fabric 10 exhibits an improved drying efficiency in portion "B" in operation on a paper making machine. The increased area of contact between the peaks 16 and 22 and the paper sheet 24 being dried promotes faster drying in this portion of the fabric and results in more uniform sheet moisture profiles.

While it is preferable that the machine direction yarns in the fabric of the invention are not abraded and remain substantially intact, since they are the load-bearing yarns of the fabric 10, it should be understood that the invention may be practiced with machine directions dominant at the surfaces and abraded to effect the desired increased surface contact area.

In addition, as shown in FIGS. 1 and 3, the lateral margins "A" and "C" of the fabric 10 and the belt 34, running in the machine direction contain yarns (both machine direction and cross-machine direction yarns which are not abraded, i.e.; the knuckles of the yarns are not abraded to increase the surface area of the contact points between the carried web of paper 24 and the belt 34. There are two results of this structure: First, the lateral margins "A" and "C" are stronger where needed (at the edge portions) and resist hydrolytic degradation to a higher degree. This is due to the fact that the cross-machine direction yarns protect the machine direction yarns. Secondly, because the lateral margins "A" and "C" have substantially less contact surface area between paper web 24 and fabric 10, than is found in the center portion "B", the drying rate is varied across the width of the fabric 10 during its use as a dryer felt. The drying rate is speeded up for paper web 24 carried on the center portion "B" of the fabric 10, in comparison to the portion of paper web 24 carried on the margin yarns "A" and "C". This compensates for the problem of a wetter center found in the prior art and solves this prior art problem described above.

Figure 4:
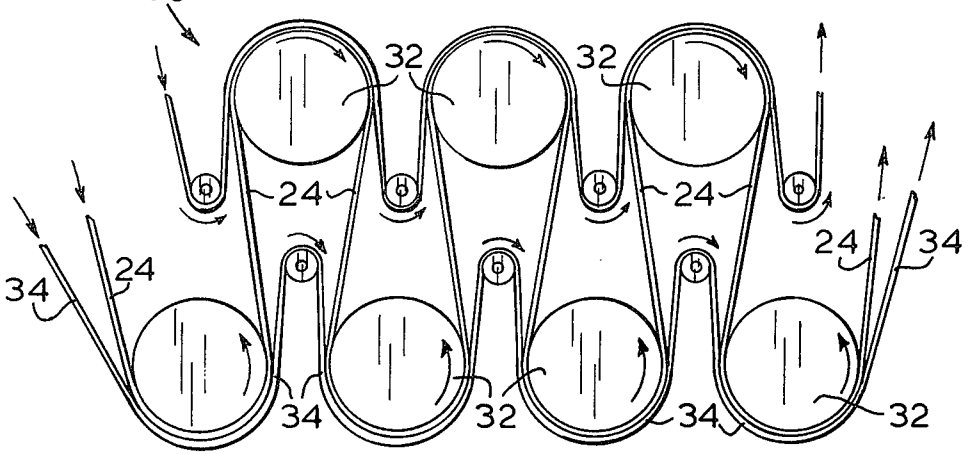
FIG. 4 is a schematic view of a portion of a drying section in a paper making machine.

The fabrics of the invention may be woven flat and the ends joined by conventional seaming methods, known to those skilled in the art. FIG. 3 is a view-in-perspective of a dryer felt 34 formed by making the fabric 10 endless with a seam 38. The seamed belts so made are readily employed as dryer felts in the dryer section 30 of a paper making machine as shown in FIG. 4. As shown in FIG. 4, the paper sheet 24 is held against the steam cylinders 32 by the endless belt 34 of fabric 10 during passage of sheet 24 through dryer section 30.

The following example sets forth the best mode contemplated by the inventor of making and using the invention but is not to be considered as limiting.

EXAMPLE 1

A fabric is prepared in a duplex weave of 0.016" diameter polyester monofilament (80 per inch) machine direction yarns interwoven with 0.016" diameter polyester monofilament (50 per inch; 25 top and 25 bottom) filling or cross-machine direction yarns. The width of the woven fabric is 200 inches. After heat setting, a fabric is obtained having only cross-machine direction yarns in the outer plane of the fabric. The upper surface of the fabric 150 inches, inwardly of the outer fabric edges is subjected to abrasion to remove up to 0.005 inches of the cross-machine direction knuckles. This leaves the abraded knuckles providing 29.3% of the surface area of the fabric in the center portion. The increase percentage of surface area making contact at varying degrees of knuckle abrasion up to 0.005 inches is shown in the Table 1, below.

TABLE 1

| Inches Removed by Sanding | Increase in Percent Surface Contact |
|---|---|
| 0 (not sanded) | 0 |
| 0.002 | 215 |
| 0.00325 | 305 |
| 0.005 | 375 |

Both sanded and unsanded fabrics are used to make endless dryer belts and each is tested on a papermakers' machine in the dryer section. It is observed that the runs with the sanded fabric of Example 1 improve the drying rate by 2–10 percent in the central portion of the paper web over the drying rate achieved using the unsanded fabric. The result is a uniform moisture content across the width of the dried paper web, in contrast to a non-uniform moisture content in fabric belts.

Those skilled in the art will appreciate that many modifications of the preferred embodiments described above may be made without departing from the spirit and the scope of the invention. For example, it is possible to vary both the width of the sanded portion as well as its midpoint. Also, the fabric of the invention may be woven to include various stuffer picks, to obtain fabrics of different permeabilities as will be appreciated by those skilled in the art.

What is claimed is:

1. A fabric for use as a paper machine dryer felt, which comprises;

a first sinuous layer of cross-machine direction yarns, providing a fabric first periphery of peaks and valleys wherein a plurality of peaks are in a first outside plane and the valley floors are in a first inside plane, said peaks being of a character which provide about 20 to 50 percent of the surface area of the first periphery and 100 percent of the area which will come in contact with the paper sheet to be supported by the felt on a paper machine;

a second sinuous layer of cross-machine direction yarns, providing a fabric second periphery of peaks and valleys wherein a plurality of peaks are in a second outside plane and the valley floors are in a second inside plane;

a plurality of machine direction yarns positioned between the first and second outside planes and interweaving the cross-machine direction yarns of the first and second outside planes and interweaving the cross-machine direction yarns of the first and second layers at the points between the outside and inside planes of at least one of said first and second layers and at points within the periphery of the other of said first and second layers;

said fabric having a central portion defined and bounded by lateral margin portions along the machine direction of the fabric;

said central portion having a substantially greater sheet contacting surface area per square meter than found in the lateral margin portions.

2. An endless dryer felt for use in the dryer section of a papermakers' machine, which comprises;

a flat woven dryer felt fabric having a first end and a second end, said ends being seamed together to form an endless dryer felt belt;

said fabric comprising;

a first sinuous layer of cross-machine direction yarns, providing a fabric first periphery of peaks and valleys wherein a plurality of peaks are in a first outside plane and the valley floors are in a first inside plane, said peaks being of a character which provide about 20 to 50 percent of the surface area of the first periphery and 100 percent of the area which will come in contact with the paper sheet to be supported by the felt on a paper machine;

a second sinuous layer of cross-machine direction yarns, providing a fabric second periphery of peaks and valleys wherein a plurality of peaks are in a second outside plane and the valley floors are in a second inside plane;

a plurality of machine direction yarns positioned between the first and second outside planes and interweaving the cross-machine direction yarns of the first and second outside planes and interweaving the cross-machine direction yarns of the first and second layers at the points between the outside and inside planes of at least one of said first and second layers and at points within the periphery of the other of said first and second layers;

said fabric having a central portion defined and bounded by lateral margin portions along the machine direction of the fabric;

said central portion having a substantially greater sheet contacting surface area per square meter than found in the lateral margin portions.

3. The fabric of claim 1 wherein the cross-machine direction yarns are monofilaments.

4. The fabric of claim 1 wherein the cross-machine direction yarns are multifilament yarns.

5. The fabric of claim 1 wherein the machine direction yarns interweave with the cross-machine direction yarns at points between the outside and inside planes of each layer.

6. The fabric of claim 1 wherein said percent is within the range of from about 10 to 30 percent.

7. The fabric of claim 1 wherein the machine direction yarns are monofilaments.

8. The fabric of claim 1 wherein the machine direction yarns are multifilament yarns.

* * * * *